US009192244B2

(12) United States Patent
Rand

(10) Patent No.: US 9,192,244 B2
(45) Date of Patent: Nov. 24, 2015

(54) TUNNEL GENERATING BED COOLING SYSTEM

(71) Applicant: Michael Bennet Rand, Petaluma, CA (US)

(72) Inventor: Michael Bennet Rand, Petaluma, CA (US)

(73) Assignee: Michael Bennett Rand, Petaluma, CA (US)

( * ) Notice: Subject to any disclaimer, the term of this patent is extended or adjusted under 35 U.S.C. 154(b) by 0 days.

(21) Appl. No.: 13/746,293

(22) Filed: Jan. 21, 2013

(65) Prior Publication Data

US 2014/0201910 A1 Jul. 24, 2014

(51) Int. Cl.
*A47C 27/00* (2006.01)
*A47C 21/04* (2006.01)

(52) U.S. Cl.
CPC ..... *A47C 21/044* (2013.01)

(58) Field of Classification Search
CPC ..... A47C 21/044; A47C 21/042; A47C 21/00
USPC ..... 5/421, 422, 423, 284, 724, 726, 941
See application file for complete search history.

(56) References Cited

U.S. PATENT DOCUMENTS

| | | | | |
|---|---|---|---|---|
| 3,230,556 | A * | 1/1966 | Shippee | 5/423 |
| 6,711,767 | B2 * | 3/2004 | Klamm | 5/423 |
| 7,631,377 | B1 * | 12/2009 | Sanford | 5/423 |
| 7,913,332 | B1 * | 3/2011 | Barnhart | 5/423 |
| 2004/0153132 | A1 * | 8/2004 | Cobb et al. | 607/104 |
| 2006/0085911 | A1 * | 4/2006 | Tompkins | 5/423 |
| 2006/0101577 | A1 * | 5/2006 | Lussier | 5/423 |
| 2008/0060131 | A1 * | 3/2008 | Tompkins | 5/423 |
| 2010/0005588 | A1 * | 1/2010 | Christopher | 5/423 |
| 2011/0010014 | A1 * | 1/2011 | Oexman et al. | 700/276 |

OTHER PUBLICATIONS

Archive of www.mybreeze.net—files 13746293—controller, courtesybars, fan, installation, remote, What Is It, and windtunnel.* Capture of May 3, 2010 entry of http://www.menopausegoddessblog.com/?s=mybreeze—file 13746293-blog.*

* cited by examiner

*Primary Examiner* — Timothy D Collins
*Assistant Examiner* — Richard G Davis

(57) ABSTRACT

Human skin surface cooling system used in bed during sleep, directing forced room air to an area above a flat mattress and under a top bed sheet, creating a tunnel of cool, moving air. User pre-selects air volume and run time, triggering a preset operating cycle from a remote actuator button. Weight bars isolate cooled bed area from non-cooled area. Optional fragrance and sound systems are provided.

29 Claims, 12 Drawing Sheets

TUNNEL GENERATING BED COOLING SYSTEM

FIELD

An in bed cooling system utilizing room air.

BACKGROUND

Among a high percentage of normal menopausal women, one of the most annoying symptoms is the so-called "hot flash", a periodic vaso-motor dysfunction usually caused by a reduction in the body's natural estrogen level. The flash is widely accepted as an unremarkable byproduct of menopause and not considered an illness or disease. Flashes typically taper off within 2-4 years of onset, but for as long as they last, they can be a serious irritation, especially during sleep.

While hot flashes can occur throughout both day and night, this disclosure deals specifically with episodes experienced while a user is reclining in a horizontal position on a typical mattress type bed with top sheet and blanket style body covering. The average flash lasting 2-5 minutes can occur 4-6 times or more per night. They are often severe enough to repeatedly disrupt normal sleep.

The hot flash wakes the sufferer without warning with a sudden and distressingly intense burst of excessive internal body heat. The resulting physical discomfort reaches maximum intensity within seconds of onset. Efforts to find rapid relief (bed covers thrown off, windows open, fans turned on, etc) can be marginally helpful, but often it's too little relief, too late. Additionally, these haphazard efforts to cool off have two significant downsides: 1) they further awaken the sufferer and 2) they set the stage for a second round of misery as the body's internal temperature normalizes just a few minutes later. Steps previously taken to cool off are not easily discontinued as the 'flash' ends and the sufferer tries to return to sleep. Open windows, blowing fans, etc, still deliver cool air, creating an equally severe but opposite problem of acute skin chilling, ironically exacerbated by the body's own cooling mechanism of profuse skin perspiration. The vulnerably exposed sufferer finds herself again fully awake—and again, in significant discomfort, shivering from damp skin in what has just become bone chilling night air. This vicious cycle of excessive hot and cold body temperature swings can repeat unabated throughout the night, robbing the sufferer of up to 2-3 hours of normal sleep.

The highly consistent and predictable nature of the menopausal 'hot flash' is relevant to this disclosure as the design of this cooling system was conceived and developed specifically to be able to match the time and intensity of the flash attack and thereby effectively neutralize the distress caused. An effective solution is possible by pre-selecting an optimized cooling cycle, which when coupled with a means for minimal effort activation provides instant, automatically timed relief. Ultimately, while not trying to prevent the flash itself, this approach significantly reduces sleep loss without hormone replacement drugs or life style changes.

Existing systems, such as the Bedfan® by Thomkins Research or Bed Fan by Brookstone and is of similar design to Bedfan, provide a low pressure, low volume, low velocity continuous flow rather than a high pressure, high volume high velocity pulsed airflow, and these existing systems are incapable of lifting typical bedding sufficiently so as to provide cooling air flow along the entire length of the sleeper's body, or to further provide additional air flow out through openings in the bedding to cool the neck and face of the sleeper.

BRIEF SUMMARY OF THE INVENTION

A system, device and method is described for a precision controlled human skin surface cooling system that generates a predetermined quantity of moving air for a predetermined time. This airflow may be activated with various automatic or manually operated activation devices. A plurality of airflow and operating time presets are stored in a system control device for immediate recall by the user. The system is adaptable for temporary, non-destructive installation into a variety of bedding types and styles.

A device and method is described for temporarily isolating the moving air to the user's side of the bed with a set of varying length weight tubes or other similarly functional barriers.

One embodiment of this system is intended to increase comfort during sleep by providing sufficient air pressure under top bed covers to lift bedding off a user's body. This quickly inflated 'wind tunnel' delivers a preset volume and velocity of airflow that moves across and around the user's entire body. This immediate skin surface cooling quickly removes the periodic, excess body heat that can occur during sleep from a variety of causes, including but not limited to, pregnancy, menopausal hot flashes, side effects of cancer or other disease related treatments, or normally occurring natural perspiration.

Additional embodiments are disclosed that include optional systems to further reduce the annoyance and discomfort of being awakened by providing pleasing fragrances and user selected soothing sounds or music.

DETAILED DESCRIPTION OF THE VARIOUS EMBODIMENTS

Sufficient air pressure and volume is generated and may be introduced near the foot of the bed, between bedding layers causing the bedding to lift or inflate in a cocoon like manner around a supine sleeper. The lifted or inflated bedding together with the forced air movement may be of sufficient velocity and volume and pressure to create a wind tunnel-like effect under the bedding. The rapid air movement may be in direct contact with, and may pass over and around the sleeper's skin surface except where skin is either covered by night clothes, or where the sleeper's skin surface is in direct contact with the mattress. The cooling system may be shaped to provide a low profile appearance when installed in a bed, and may use multiple spinning fan blade assemblies operating concurrently to achieve the desired air pressure and velocity necessary to fully lift the bedding and provide appropriate air flow. The bed cooling system may be designed to operate quietly to minimize fan noise and may be located at the foot of the bed on a support assembly, or positioned in some other nearby location with the moving air being guided through flexible and/or collapsible ducting and affixed to the base of the bed near a user's feet.

The cooling system may provide cooling to fully lift bedding of a variety of different weights. A typical sheet may weigh 29 oz with an area of 57 $ft^2$, or 0.51 $oz/ft^2$, while a blanket may have a weight per unit area of 0.75 $oz/ft^2$ to 2.0 $oz/ft^2$ or more, and bedspreads may have weights per unit area even greater than that of blankets. In some bedding configurations, wherein a sheet is combined with one blanket and a bedspread, the total weight per unit area can typically be 3.0 $oz/ft^2$, while when a sheet is combined with two blankets and a bedspread, the weight per unit area can be 4.0 $oz/ft^2$, when utilizing bedding of average weight. These weights per unit area can be significantly higher if heavy wool blankets or similar bedding are utilized. Thus to provide effective lifting of bedding, a bed cooling system may need to be able to lift as much as 6 to 8 $oz/ft^2$, or equivalently may need to provide as much as 0.1 inches of water pressure to lift the bedding.

A system which is only capable of lifting a sheet may not create an appropriate tunnel. As described hereinafter in experiment 3, a sheet has insufficient weight to seal against the side of the bed, and lets most air escape without reaching the head of the bed, and thus does not reach the head, neck and chest of said suffering menopausal woman, which are the regions that are subject to the largest temperature changes, and thus the greatest discomfort.

Figure 1:
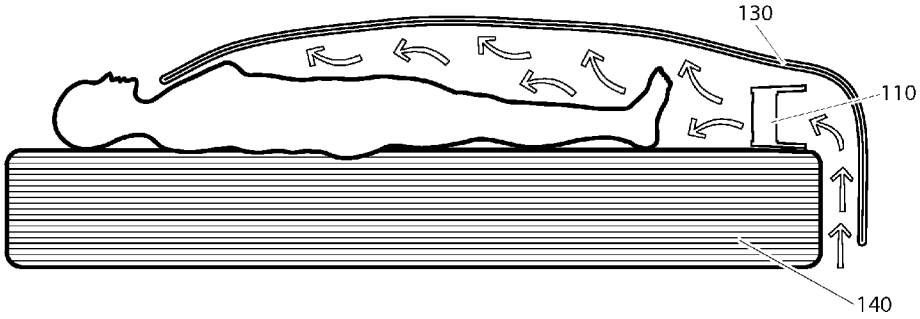
FIG. 1 illustrates the interior of a tunnel formed by the cooling system according to various embodiments.

FIG. 1 illustrates a view of a bed cooling system 110 from within the tunnel (not labeled) formed by said bed cooling system 110 is shown forming the tunnel between the top bed sheet 130, and the bottom sheet covering the mattress 140. The tunnel fully lifts the bedding from upon the user, and provides air flow around and along the user's body.

Figure 2:
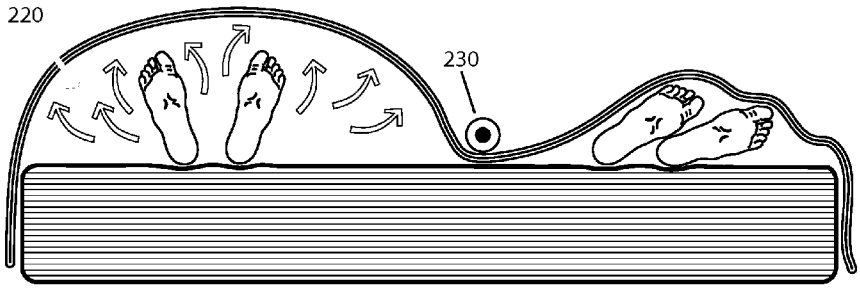
FIG. 2 illustrates an exterior view of a bed with a fully formed tunnel according to various embodiments.

FIG. 2 illustrates an external view of an installed and operating bed cooling system forming a tunnel 220, wherein exiting air is directed towards the head and neck of the user. Padded weight bars 230 maintain bed cooling system formed tunnel on one side of the bed, optimizing flow for one user, and minimizing disturbance for another user on the other side of the bed.

Figure 3:
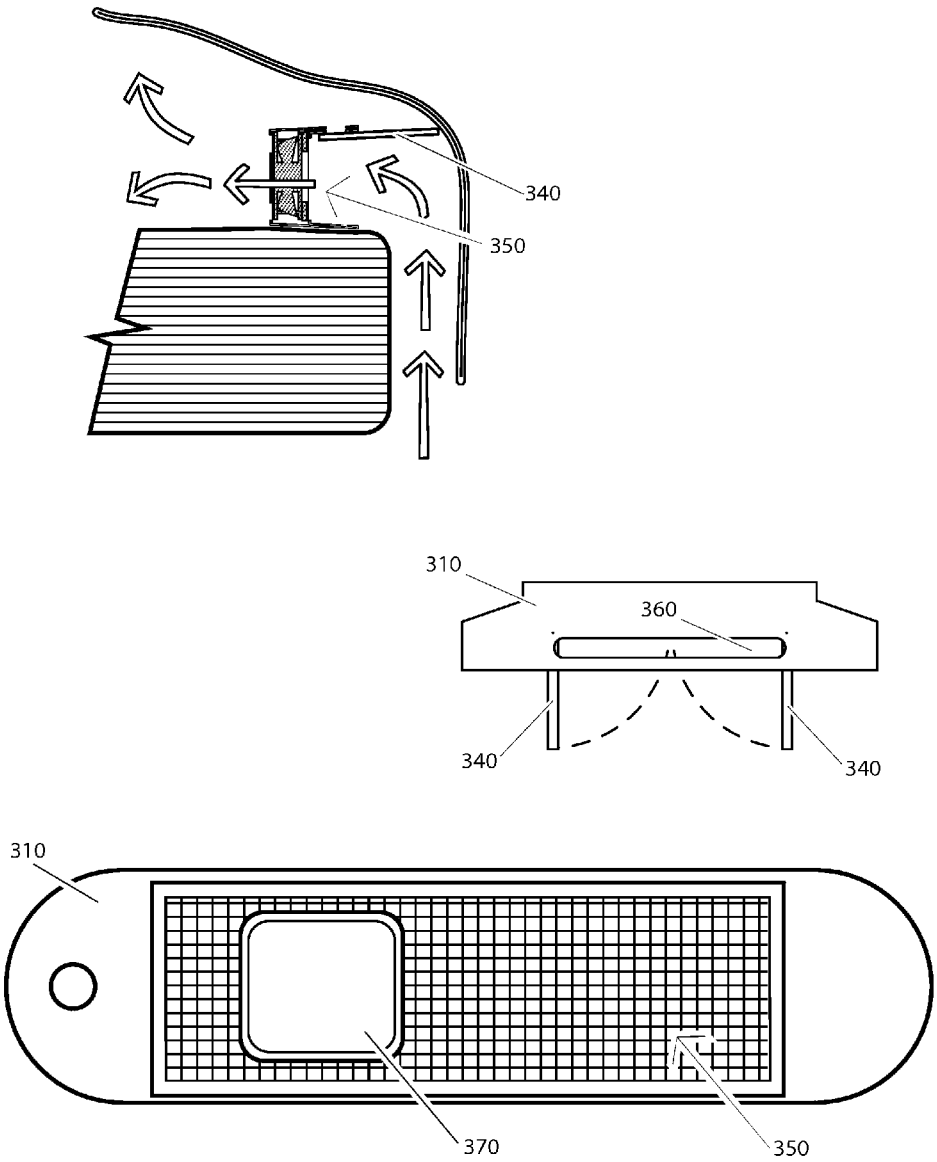
FIG. 3 illustrates a rear view of the cooling system including the optional sound system according to various embodiments.

As illustrated in FIG. 3, for non-footboard bed designs, pivoting arms 340 may pivot perpendicular from the bed cooling system 310 toward the rear of the unit to act as a means to support the bedding up and away from the air intake 350. These pivoting arms 340 may also optionally provide bracing support accommodating a connecting bridge plate (not shown) that spans the gap between the pivoting arms 340 when said pivoting arms 340 are both arranged such that they are positioned to allow said bridge plate to be connected to and supported by the pivoting arms 340. FIG. 3 illustrates pivoting arms 340 on a bed cooling system 310 in a fully extended position. FIG. 3 further illustrates an attachment slot 360 in bed cooling system 310, as may be utilized for attachment of bedding, and a speaker system 370.

Figure 4:
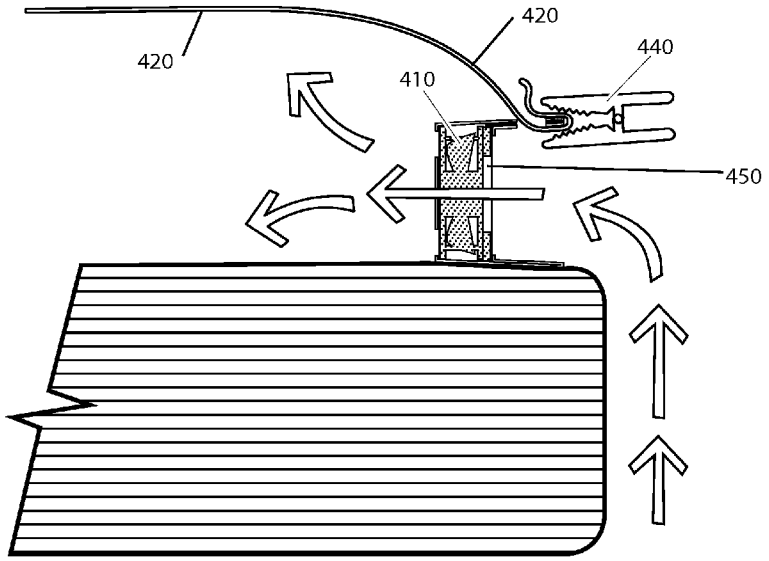
FIG. 4 illustrates the bedding support brackets in the extended positions and sheet attachment clips, and affixed bedding according to various embodiments.
Figure 4:
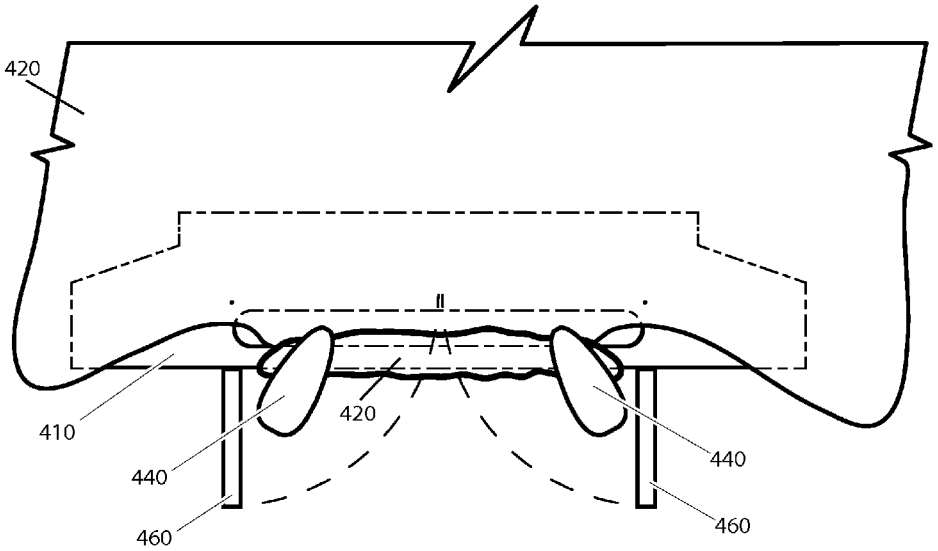

In one embodiment, as illustrated in FIG. 4, a means is provided for the attachment of the bed's top sheet 420 to the air cooling system 410 without permanent modification of the bedding. The top sheet 420 may be held in place with sufficiently strong gripping force so as to prevent displacement that a user might otherwise cause by pulling on the top sheet 420 during sleep. Said top sheet 420 may be affixed and secured to said bed cooling system utilizing spring clamps 440. With the top sheet 420 secured to the bed cooling system 410, the user may, in order to reduce the time delay to receiving the air coming from the bed cooling system, tug on the top sheet 420 from a normal sleeping position. This may lift the top sheet 420 and any other bedding, clearing the space in front of the bed cooling system 410, and allow air pressure from the bed cooling system 410 to more quickly create a tunnel, as described herein. Pivoting arms 440 are shown in a position perpendicular to said air cooling system 410 such that top sheet 420 or any other bedding are kept from blocking the air intake 450 for the air cooling system 410.

Figure 5:
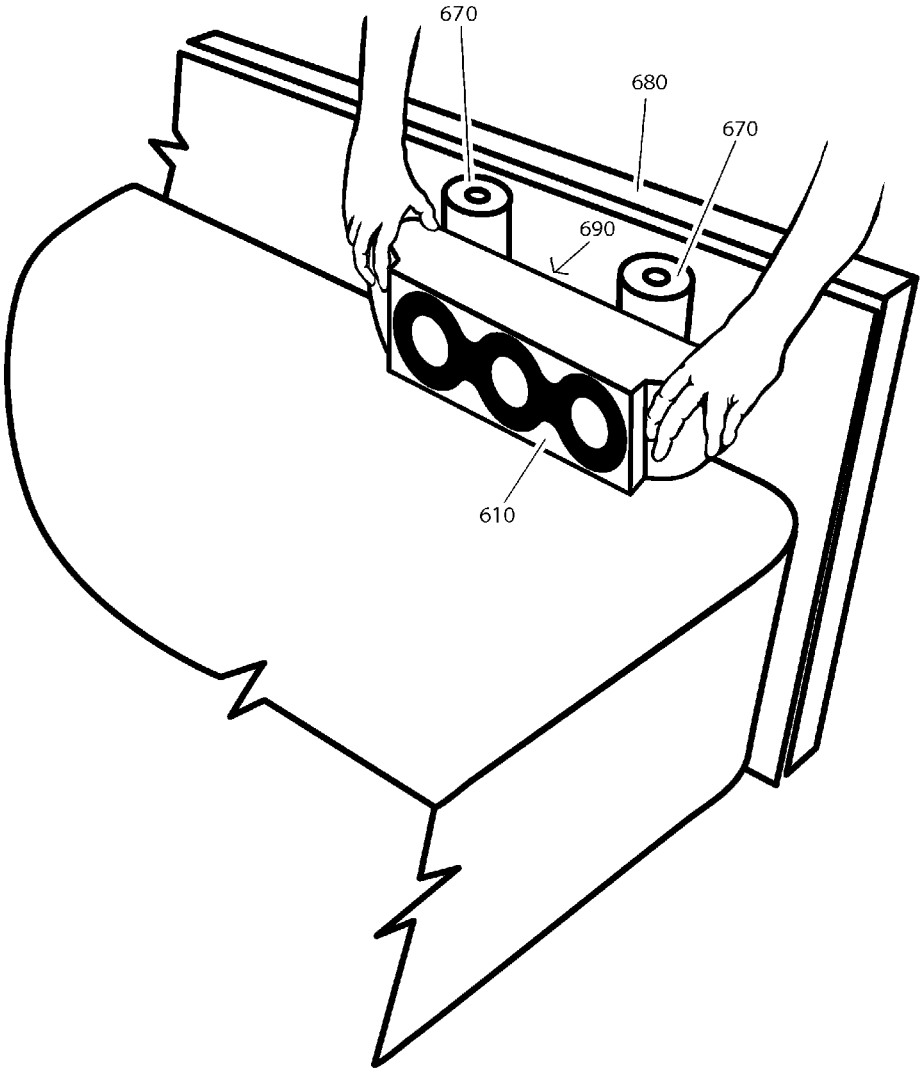
FIG. 5 illustrates the complete cooling system being installed in a bed with a footboard and spacer tubes according to various embodiments.

Bed cooling system housing may be designed to accommodate both non-footboard and footboard style bedding. As illustrated in FIG. 5, for footboard style bedding, two foam cylinders 670 may be placed between said footboard 680 and a bed cooling system 610. This may create an air gap 690 that may permit intake air to enter the rear of the bed cooling system 610.

A bed cooling system that may be mounted at the foot of the bed, wherein it may be attached to a slotted vertical support post with an adjustable 'L' bracket configured to act as a mattress clamp to maintain the position of the bed cooling system with respect to the mattress that can adjustably slide up or down within the 'L' bracket height adjustment slot to accommodate a variety of mattress thicknesses. The 'L' bracket may be inserted under the mattress which may be covered with a bottom sheet to stabilize the bed cooling system from shifting during use.

The bed cooling system housing may also be mounted on a supplementary support brace that may provide greater stability of the unit in the event the user is tall or restless and may be prone to dislodge the unit from its intended position by inadvertent kicking during sleep. Dual mounting attachment orientation allows the bed cooling system to be positioned either over the end of the foot of the mattress, or allows the bed cooling system to extend just off the end of the foot of the mattress providing greater leg clearance for the user.

Figure 6:
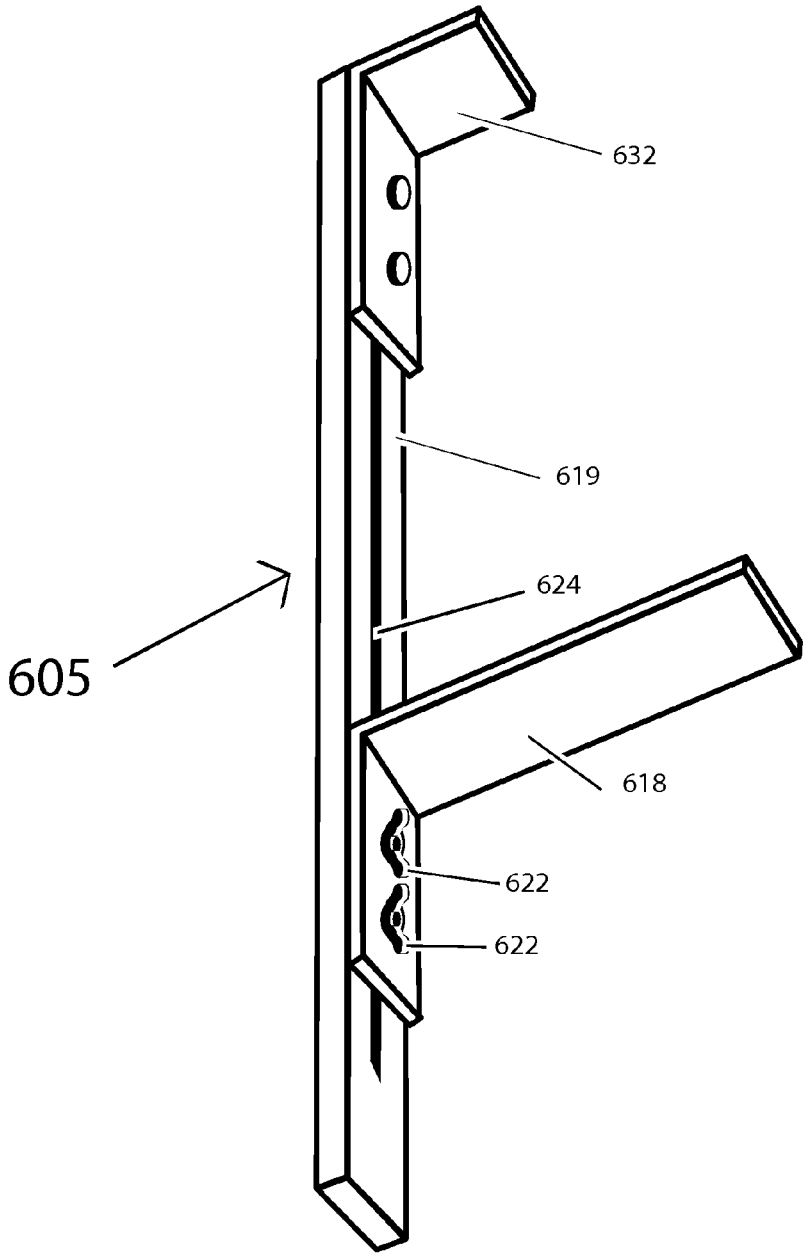
FIG. 6 illustrates the 'L' bracket, slotted support post, system mount bracket, according to various embodiments.

FIG. 6 illustrates an exemplary support assembly 605 which may be used for stabilizing a cooling system in place on a bed, comprising 'L' bracket 618 attached to an exemplary slot post 619 which may be used to accommodate variation in the thickness of the mattress by loosening the 'L' bracket attachment hardware 622 such that the 'L' bracket 618 can be moved up or down in the 'L' bracket height adjustment slot 624. FIG. 6 further illustrates a bed cooling assembly bracket 632 affixed to exemplary support assembly 605, which may be utilized for attachment of a bed cooling system to the support assembly 605. Said cooling assembly may be mounted in two different orientations whereby said bed cooling system may be mounted either on a mattress, or off the bed, allowing the full length of the mattress to be utilized by a user.

Figure 7:
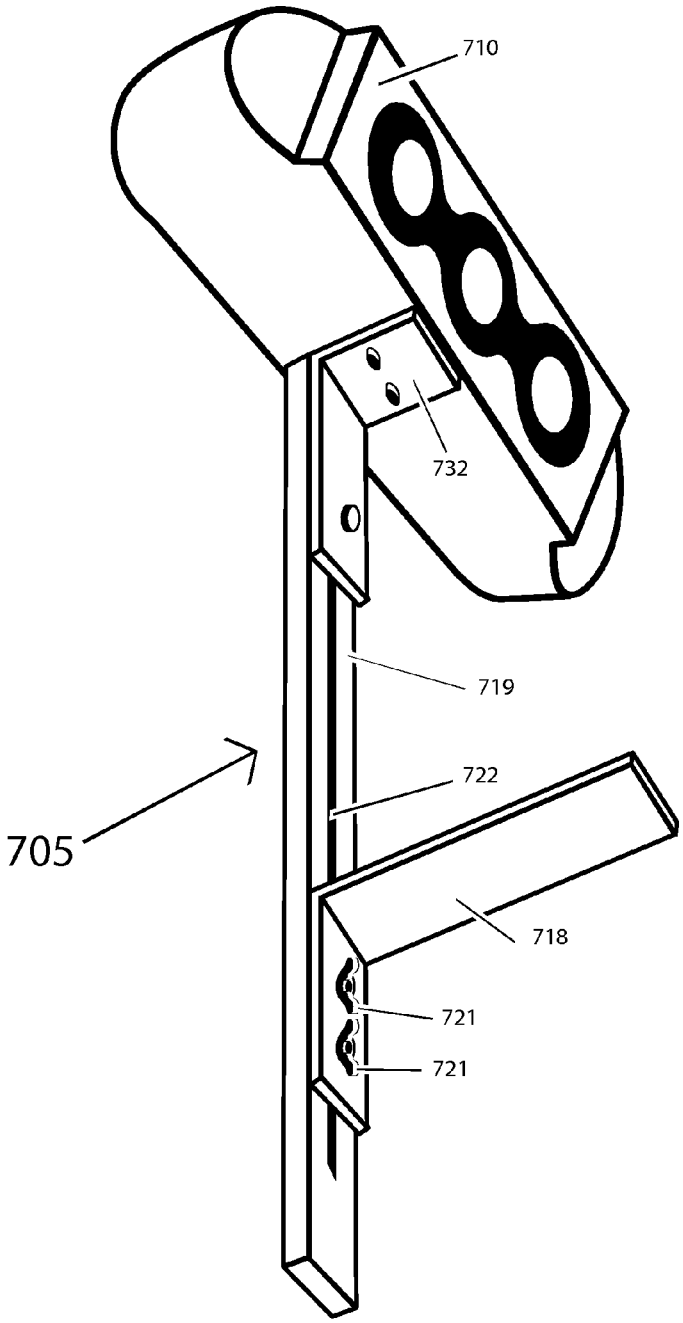
FIG. 7 illustrates the complete cooling system, including cooling system mounted on the primary structural support, including system mount bracket, slotted support post, and 'L' bracket, according to various embodiments.

FIG. 7 illustrates a view of said exemplary support assembly 705 configured for use with bed cooling system 710 placed on the foot of a bed, wherein bed cooling assembly bracket 732 is positioned on slot post 719 in the same orientation as 'L' bracket 718. A user may adjust for various thicknesses of mattresses by loosening L bracket attachment hardware 721 and sliding 'L' bracket 718 within 'L' bracket adjustment slot 722 along slot post 719.

In other embodiments the bed cooling system may be supported on the floor, or attached to the mattress with Velcro or other similar temporary attachment means. Other bed cooling system support means are possible. In one embodiment the bed cooling system (or air exit tube) may be positioned to provide a sufficient volume of moving air to fully engulf the user's body without disrupting their normal sleeping position.

Figure 8:
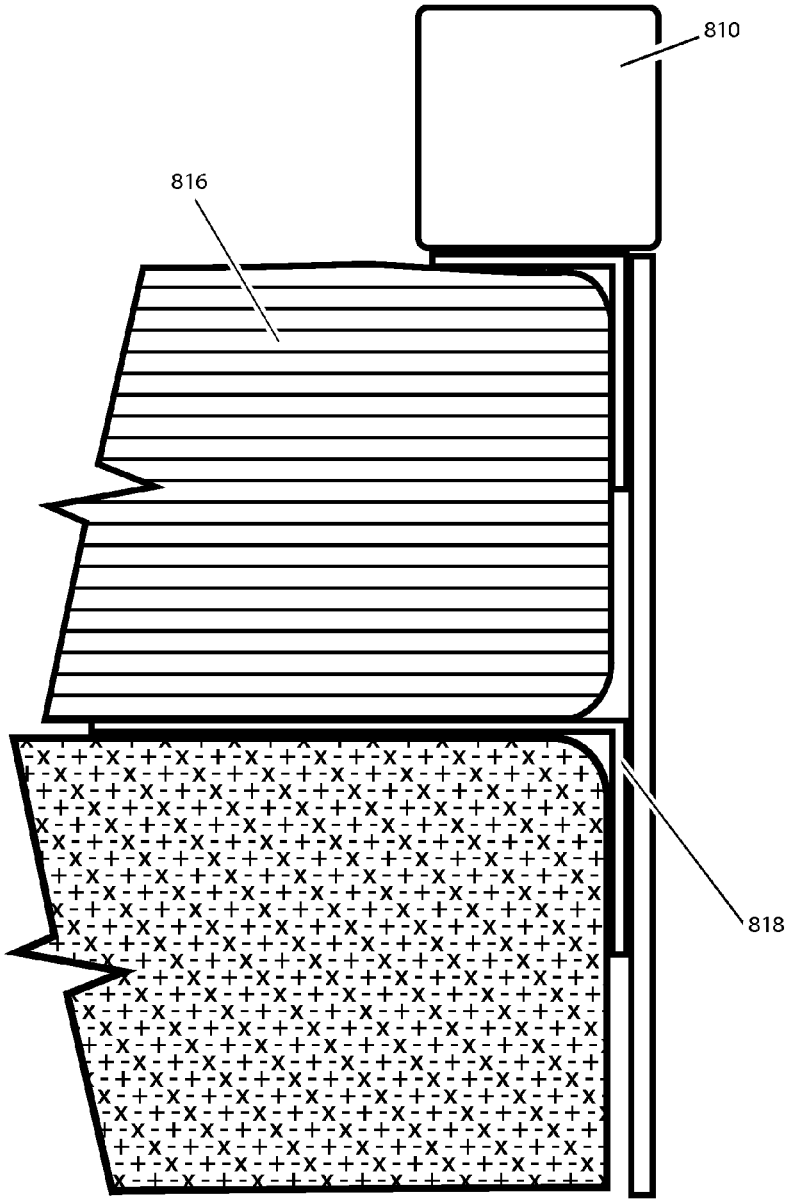
FIG. 8 illustrates a cooling system and support brace mounted in a bed according to various embodiments.

FIG. 8 shows an exemplary bed cooling system 810 as adjusted to be utilized for a bed. Bed cooling system 810 has the 'L' bracket 818 adjusted to provide stable positioning relative to a mattress covered with a bottom sheet 816.

Figure 9:
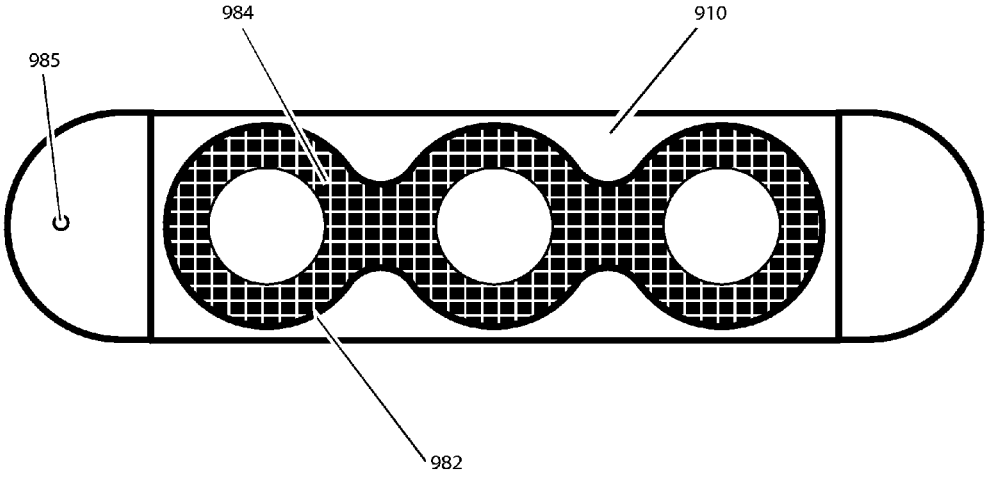
FIG. 9 illustrates a front view of the cooling system according to various embodiments.

FIG. 9 illustrates the outlet of a bed cooling system 910 with three merged outlets 982, and screening to prevent inadvertent contact between the bed cooling system fans 984 and the user. LED indicator 985 may be used to indicate that the bed cooling system is in the programming mode whereby said bed cooling system time period for cooling may be set by the user.

Weighted and padded tubes may be covered in fabric with soft handles and may be used to separate the cooled segment of the bed from an area where an additional occupant may be sleeping that doesn't require moving air over their body while sleeping, and for whom, the cooling air flow might otherwise be an annoyance.

In some embodiments, a device is provided for isolating the air from the skin cooling system from reaching a sleeping bedmate's side of the bed.

Figure 10:
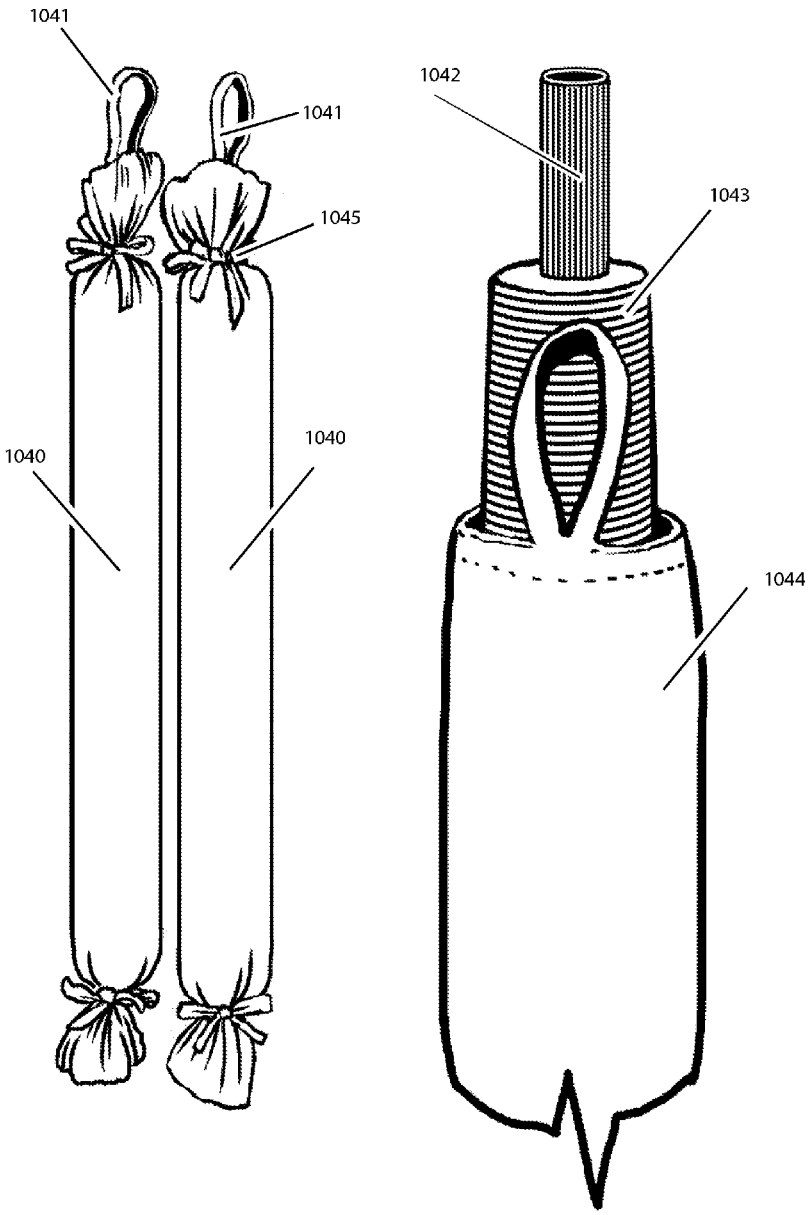
FIG. 10 illustrates wind isolation weight bars and assembly components according to various embodiments.
Figure 11:
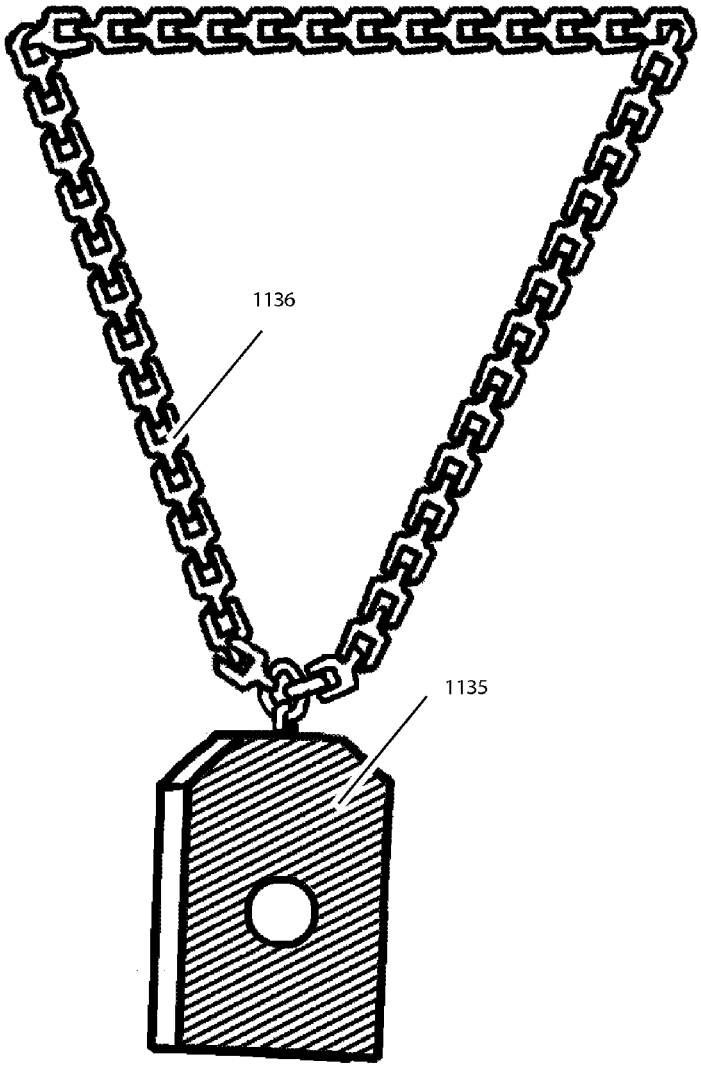
FIG. 11 illustrates a remote activator button according to various embodiments.

One embodiment of these teaching is a set of padded weight bars 1040 as illustrated in FIG. 10, which may consist of two –2' long weighted cores 1042 (which may be 4-5 lbs. ea.), fitted with foam padding 1043 and covered with washable coverings 1044 and pull handles 1041 at the end(s) of the padded weight bars 1040, wherein the weighted cores 1042 and foam padding 1043 may be held within the washable coverings 1044 by tie-off ribbons 1045. Padded weight bars 1040 may be positioned together at the foot of the bed, oriented parallel to the sleepers and may be positioned approximately midway between them. When the bed cooling system is active, one of the two bars may be pulled forward into alignment with the other creating a combined 4' long soft barrier between the sleepers on top of the bedding. Either partner may choose to prevent the airflow created by the bed cooling system from extending over to the non-cooled sleeping area. The forward bar can then be easily pushed back into place at the foot of the bed again permitting bedmates to be in physical contact again.

Other embodiments of these weight bars may be configured in any shape, length or weight; for example the padded weight bars may effectuate a longer or shorter barrier, such as a 3' barrier, a 3' to 4' barrier, a 5' barrier, or a 4' to 5' barrier. The material may be such that the padding material and the weight material may be the same material, wherein the shape of the padded weight bar is maintained by the cover of the padded weight bar tightly fitting around said combined padding and weight material. More bars or fewer bars may be utilized, and said bars may be shorter or longer than 2', and may be lighter or heavier than 4-5 lbs ea. Said bars may be linked or affixed, or may be separate, or may comprise shorter bars which are linked or affixed, wherein non linked or affixed sets of linked or affixed bars may be utilized to create a barrier.

A remote user activated button 1135 may be a small, wireless transmitter button, which may be kept near the user's hand so as to be immediately reachable during the night. In one embodiment, the remote user activated button may be worn around the user's neck as a pendant wherein said remote user activated button 1135 may be retained with a pendant chain 1136. In other embodiments, remote user activator button(s) 1135 may be mounted to a headboard or nightstand. In another configuration, a remote user activated button can be worn on a wrist or forearm, with, or without a small button extension that attaches to a user's fingertip. Wherever the remote user activator button is located, the user may depress the button momentarily to activate the preset time/power cycle of the bed cooling system, or to activate other functions of the bed cooling system as described herein. In another embodiment, the remote user activator button may be used in parallel with a temperature or galvanic skin response (GSR) sensor such that upon reaching a preset temperature or GSR value may activate the bed cooling system.

The remote user activation button may provide the user an activation method of the skin cooling system which may be utilized while not fully awake.

An electronic timer/controller may operate the air cooling system. Preset time and power options may be preset by the user and activated on demand through a remote actuator switch kept in a position physically proximate to the sleeper's upper body location (e.g. under a pillow, on a pendant around the neck, mounted to the headboard, or on a bedside table). The timer/controller may allow an auto reset of the preset time/power program which permits unlimited activations throughout the night that can produce the exact same cooling system operating behavior following activation, regardless of whether a user intentionally or unintentionally stops an activation before the completion of a time cycle, or whether a time cycle runs to it intended completion. The activation, power setting, and duration of operation may be controlled by the user through the use of a single button via a software programming protocol that greatly simplifies user control. The single button activator may be in communication with a main electronic controller unit without use of a connecting cable. Continuous activation of bed cooling system may also be enabled with single button remote.

A controller unit that controls the operation of fans contained within the bed cooling system may be contained within the bed cooling system housing, and may provide a user interface wherein a display and user controllable input switches are provided to allow user input. In an alternative embodiment, there may be no accessible user interface other than the remote user activated button, which may allow control and configuration of the bed cooling system as further described herein. Software that controls the bed cooling system may in some embodiments provide the user with a plurality of power and time settings. In one embodiment for use in the treatment of 'hot flash' discomfort, the user's power/time selection may be adjusted to closely match both the duration and intensity of that user's hot flash severity and duration. In some embodiments, the user may select a power/time setting on the controller through an optional pair of controller program entry buttons with the selection visibly confirmed through an optional controller program display window.

In one embodiment of the current teachings, at the end of the user selected time/power cycle, the bed cooling system may automatically turn off the bed cooling system without further action required by the user. In an alternative embodiment, the user may alternately turn off the bed cooling system anytime during the preset time cycle by another push of the remote user activator button. In a further embodiment, controller unit software may provide the user with the opportunity to select a multi-step time/power cycle so that an initial high power cooling system fan speed for a given time is followed immediately by a reduced power cooling system fan speed for a second preset period of time before turning off the bed cooling system. Similarly, additional program steps may be included in the sequence.

In one embodiment, controller software may additionally offer users the option of continuing to operate the bed cooling system at a preset low power cooling system fan speed, providing a lower level of ongoing air movement throughout the night, instead of turning off the bed cooling system at the end of the preset cooling cycle.

In another embodiment, controller software may additionally offer users the option to automatically turn on the bed cooling system periodically for the purpose of replacing warmer air trapped between the sheets with 'fresher' and/or lower temperature outside air. In another embodiment may effectuate this intra-sheet air replacement function by the use of a pre-settable user controlled temperature sensor located at or near the bed cooling system monitoring air temperature between the bedding layers and upon reaching the preset air temperature, automatically activate a cycle of air replacement until the preset lower air temperature is reached, shutting off the bed cooling system.

The cooling system may incorporate a means of dispelling a light fragrance into the moving air stream. A partially sealed compartment with an air pressure activated vent permits a fragrance saturated module to release small amounts of fragrance during each bed cooling system 'on' cycle. Different scents may be introduced at will by the user into the compartment.

Figure 12A:
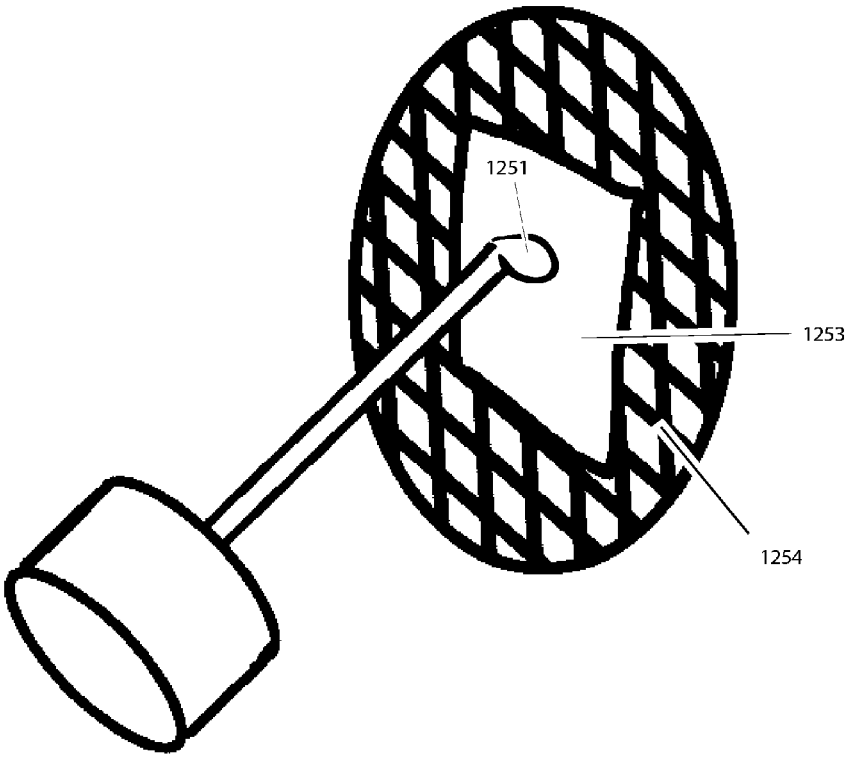
FIGS. 12A and 12B illustrate the preparation and installation of the fragrance pad into the fragrance pad retainer.

FIG. 12A illustrates the addition of a fragrance 1251 to a fragrance pad 1253 held in a fragrance pad retainer 1254. Said fragrance pad 1253 may be an absorbent membrane such as a paper towel. The user may determine fragrance intensity by using various dilutions and or quantities of fragrance deposited on said fragrance membrane 1253.

Figure 12B:
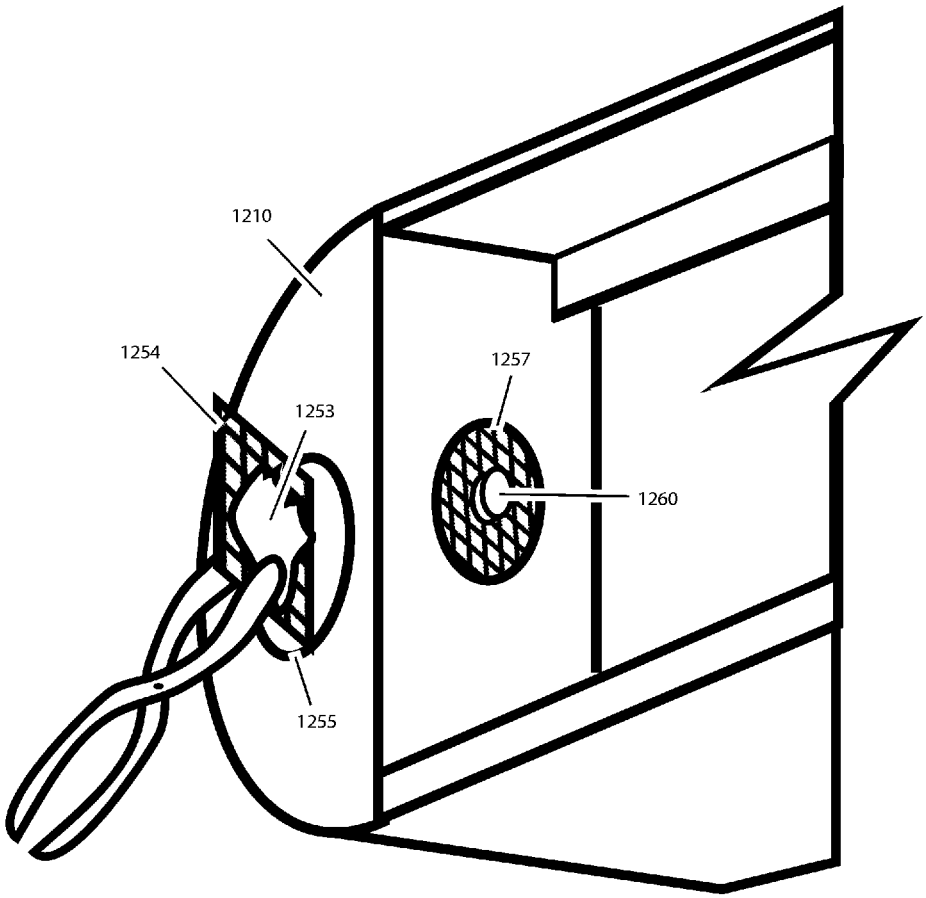

FIG. 12B illustrates the placement of a fragrance pad 1253 and fragrance pad retainer 1254 into a bed cooling system 1210 through rear fragrance port 1255. Said fragrance pad retainer 1254 may comprise a ferric material, such that said fragrance pad retainer 1254 may be held in place by a magnet 1260 affixed to internal fragrance port 1257 as shown in FIG. 12B. FIG. 12B also illustrates internal fragrance port 1257 between fragrance chamber and air flow chamber in bed cooling system 1210 whereby air flow may produce a venturi effect resulting in moderate mixing between said fragrance chamber and said air flow chamber, allowing small amounts of fragrance to be drawn out of said fragrance chamber and expelled towards the user.

FIG. 3 illustrates an embodiment of an integrated music/sound emitter device 370. This device may be activated and deactivated with the fan cooling system 310, turning on at the same time that fan(s) turn on. The music/sound may turn off at the end of an 'on' cooling cycle for the fan(s), or may be configured to continue for a set period of time thereafter. If the music/sounds are configured to continue for a period of time after the end of a cooling cycle, the volume of the music/sounds may be further configured to slowly be reduced before finally stopping. The music/sound generated by this device may thus convey an audio signal conducive to a more rapid return to sleep by the user. In another embodiment of this device, the user may select and or load into an additional sound playback device (not shown) music and or sounds of their own choosing, the playback and volume of which may be controlled by the fan cooling system 310 as described hereinabove for integrated music sound emitter device 370.

In another embodiment of the system, a dual bed cooling system or a dual ducting means originating from a single bed cooling system with separately controlled air flow dampers for each ducting branch may be independently controlled by each person sharing the bed sleeping area. Either person sharing the bed may independently activate their side of the bed cooling system, each with their own unique time and air flow settings as described herein for a single bed cooling system embodiment.

EXAMPLE 1

A queen sized bed was configured with a bed cooling system as described herein mounted centered at the foot of said bed. Padded weight bars were provided on both sides of the bed cooling system atop various layers of bedding as described further hereinafter. Measurement of airflow and pressure were taken with each tested bedding configuration. Airflow measurements were taken utilizing a Ambient Weather HP816A meter. Airflow measurements were made of the airflow of air forced under said bedding and exiting from under said bedding at the opposite (head) end of the bed from which the bed cooling system introduced said air, such that exiting air would be available to cool the neck and head of a user reclining in said bed. Pressure measurements were made utilizing a Supco DDM55 meter, wherein one inlet to said air pressure meter utilized in differential pressure mode was taken utilizing a ⅛ inch inner diameter tube connecting said air pressure meter to the region at the foot of the bed in volume immediately upstream of the bed cooling system, and the second input to said air pressure meter was taken directly from the position of said air pressure meter, wherein said position of said air pressure meter was adjacent to the pillow at the head of said bed.

Four different levels of bedding were tested: a single sheet, a single first blanket in addition to said sheet, a bedspread in addition to said sheet and said blanket, and a second blanket in addition to said sheet, said first blanket, and said bedspread. The weight per unit area of the different beddings were as follows: said sheet 0.51 oz/ft$^2$, said first blanket 1.06 oz/ft$^2$, said bedspread 1.44 oz/ft$^2$, and said second blanket 1.04 oz/ft$^2$. These weight per unit areas correspond to pressures needed to lift said bedding in inches of water as the following: said sheet 0.006 in $H_2O$, said first blanket in addition to said sheet 0.019 in $H_2O$, said bedspread in addition to said sheet and said first blanket 0.036 in $H_2O$, and said second blanket in addition to said sheet, said first blanket and said bedspread, 0.049 in $H_2O$. When a tunnel was fully formed, the pressure throughout said tunnel varied very little throughout most of the volume of said tunnel, except very near any edges of the bedding wherein air exited from beneath said bedding through gaps created by the lifting of said bedding by the air pressure generated by said bed cooling system.

The pressures measured with the different levels of bedding were as follows: said sheet alone resulted in pressures of 0.0 (below the sensitivity of said air pressure meter) to 0.01 in $H_2O$; said first blanket in addition to said sheet resulted in air pressures of 0.0 to 0.02 in $H_2O$; said bedspread in addition to said sheet and said first blanket resulted in air pressures of 0.01 to 0.03 in $H_2O$; said second blanket in addition to said sheet, said first blanket and said bedspread resulted in air pressures of 0.03 to 0.06 in $H_2O$. The variability resulted from adjustment or movement of the bedding at the head of the bed; lifting up the bedding gave higher total airflow at lower velocities, and reduced the measured air pressure; pulling the bedding down gave higher air flows in the smaller exit aperture, and increased the measured air pressure.

The air flow measured with different levels of bedding were as follows: said sheet alone resulted in air flow of 5-9 mph (miles per hour); said first blanket in addition to said sheet resulted in air flow of 7-9 mph; said bedspread in addition to said sheet and said first blanket resulted in air flow of 8.5-11.5 mph; said second blanket in addition to said sheet, said first blanket and said bedspread resulted in air flow of 8-11 mph. Air flow with the sheet alone was the most variable, and was of the lowest measured flow rate, but had the highest volume (in cubic feet per minute), as the exit aperture was largest with the least amount of bedding. As additional bedding was added, the stability of the tunnel increased, as did the size of the exit aperture and the variability in air flow. In contrast, the sheet by itself often flapped in the generated air flow.

The tunnel was stable with additional bedding, as for example, when the second blanket was folded in half, or in thirds, doubling or tripling the contribution from said second blanket to a total bedding weight per unit area of 5.08 oz/ft$^2$ and 6.12 oz/ft$^2$ respectively. Significant additional bedding, such as an additional folded bedspread such that 12 or more layers of said second bedspread were utilized were sufficient to collapse said tunnel, and resulted in a pressure level of 0.25 in $H_2O$.

EXAMPLE 2

The same configuration as used in example 1 was utilized, whilst the bed cooling system of the current teachings was replaced with a commercial Bedfan® system. Not all bedding configuration as described in example 1 were utilized, as the commercial system was entirely incapable of lifting the bedding with said sheet, said first blanket, and said bedspread, such that testing with additional bedding was moot. The pressure and airflow with said sheet were as follows: 0.0-0.01 in H2O and air flow of 1.5-5 mph, with an exit aperture which was much smaller than of the current teachings. The pressure and airflow for the said sheet and said first blanket were as follows: 0.03 in H2O, but no air flow, as the tunnel did not extend the entire length of the bed. The pressure and airflow for the said sheet, said first blanket, and said bedspread were as follows: 0.03 in H2O, but no air flow, as the tunnel did not form.

EXAMPLE 3

A similar configuration to that of example 1 was utilized, but said bed cooling system was positioned on one side of said bed, as would be typically the case if there were two occupants in said bed. A single set of padded weight bars was utilized, placed in the center of the bed. The same bedding was used for testing airflow and pressure.

The pressures measured with the different levels of bedding in this third experiment were as follows: said sheet alone resulted in pressures of 0.0 (below the sensitivity of said air pressure meter) in $H_2O$; said first blanket in addition to said sheet resulted in air pressures of 0.0 to 0.02 in $H_2O$; said bedspread in addition to said sheet and said first blanket resulted in air pressures of 0.02 to 0.05 in $H_2O$; said second blanket in addition to said sheet, said first blanket and said bedspread resulted in air pressures of 0.03 to 0.08 in $H_2O$. There was significant leakage to the side of the bed with the sheet only bedding configuration.

The air flow measured with different levels of bedding in the third experiment were as follows: said sheet alone resulted in air flow of 3.5-4.8 mph (miles per hour); said first blanket in addition to said sheet resulted in air flow of 6.5-9.5 mph; said bedspread in addition to said sheet and said first blanket resulted in air flow of 8.5-12 mph; said second blanket in addition to said sheet, said first blanket and said bedspread resulted in air flow of 11-12.5 mph. With only the sheet in place, air flow at the head of the bed was minimal, as a very significant percentage of the air never reached the head of the bed. As more bedding was added, the bedding sealed against the side of the bed, preventing leakage to the side of the bed.

It is to be understood that both the foregoing general description and the following detailed description are exemplary and explanatory only. The accompanying drawings, which are incorporated in and constitute a part of this application, illustrate several exemplary embodiments and, together with the instant description, serve to explain the principles of the present teachings. Those skilled in the art can appreciate from the foregoing description that the broad teachings of the present application can be implemented in a variety of forms. Therefore, while these teachings have been described in connection with particular embodiments and examples thereof, the true scope of the present teachings should not be so limited.

What claimed is:

1. A sleeper cooling system comprising one or more fans, a controller and a wireless remote actuator, wherein the controller activates the fan as a result of a user activating said controller, and the sleeper cooling system creates a tunnel with bedding of 4 oz/ft$^2$ or more, and wherein the actuator comprises only a single user actuatable button, and wherein said single button may be utilized to select and set a preset time interval.

2. The sleeper cooling system of claim 1, wherein said remote actuator creates a tunnel with bedding of 6 oz/ft$^2$ or more.

3. The sleeper cooling system of claim 1, wherein upon activation by said remote actuator, said controller provides power to said fan(s) for a preset period of time.

4. The sleeper cooling system of claim 1, wherein said user may utilize said single button to activate and deactivate a continuous flow of air through said tunnel.

5. The sleeper cooling system of claim 1, wherein upon activation by said remote actuator, said controller provides power to said fan at a preset power level.

6. The sleeper cooling system of claim 1, wherein said remote actuator comprises a GSR sensor, and said remote actuator is activated by a GSR sensor reaching a preset level.

7. The sleeping cooling system of claim 1, further comprising weight bars to confine airflow to a user's side of a bed.

8. The sleeper cooling system of claim 1, further comprising a music system incorporated into an enclosure of said fan cooling system.

9. The sleeper cooling system of claim 8, wherein said music system is activated and deactivated associated with the activation and deactivation of said fan.

10. The sleeper cooling system of claim 1, comprising a fan and a fragrance emission device wherein said fragrance emission device is activated and deactivated associated with the activation and deactivation of the fan.

11. The sleeping cooling system of claim 1, further comprising air flow spacers configured to space the cooling system from the foot of a bed so as to allow air intake to said fan.

12. The sleeper cooling system of claim 1, further comprising swing arms configured to pivot perpendicularly to the sleeper cooling system and thereby swing arms directly support said bedding so as to allow air intake to said fan.

13. The sleeper cooling system of claim 12, wherein said bedding is affixed with clips to a slot in said sleeper cooling system.

14. The sleeper cooling system of claim 1, wherein an optional adjustable mount may be utilized with mattresses of thicknesses of between 6 and 20 inches.

15. The sleeper cooling system of claim 1, wherein an optional adjustable mount may be utilized with mattresses of thicknesses of between 3 and 30 inches.

16. A sleeper cooling system comprising one or more fans, a controller and wireless remote actuator, wherein the controller activates the fan as a result of a user activating said controller, and the sleeper cooling system creates a tunnel with bedding of 4 oz/ft$^2$ or more, and wherein the actuator comprises a single user actuatable button, and wherein said single button may be utilized to select and set a preset time interval further comprising swing arms configured to pivot perpendicularly to the sleeper cooling system and thereby to support said bedding so as to allow air intake to said fan.

17. The sleeper cooling system of claim 16, wherein said remote actuator creates a tunnel with bedding of 6 oz/ft$^2$ or more.

18. The sleeper cooling system of claim 16, wherein upon activation by said remote actuator, said controller provides power to said fan(s) for a preset period of time.

19. The sleeper cooling system of claim 16, wherein said user may utilize said single button to activate and deactivate a continuous flow of air through said tunnel.

20. The sleeper cooling system of claim 16, wherein upon activation by said remote actuator, said controller provides power to said fan at a preset power level.

21. The sleeper cooling system of claim 16, wherein said remote actuator comprises a GSR sensor, and said remote actuator is activated by a GSR sensor reaching a preset level.

22. The sleeping cooling system of claim 16, further comprising weight bars to confine airflow to a user's side of a bed.

23. The sleeper cooling system of claim 16, further comprising a music system incorporated into an enclosure of said fan cooling system.

24. The sleeper cooling system of claim 23, wherein said music system is activated and deactivated associated with the activation and deactivation of said fan.

25. The sleeper cooling system of claim 16, comprising a fan and a fragrance emission device wherein said fragrance emission device is activated and deactivated associated with the activation and deactivation of the fan.

26. The sleeping cooling system of claim 16, further comprising air flow spacers configured to space the cooling system from the foot of a bed so as to allow air intake to said fan.

27. The sleeper cooling system of claim 16, wherein said bedding is affixed with clips to a slot in said sleeper cooling system.

28. The sleeper cooling system of claim 16, wherein an optional adjustable mount may be utilized with mattresses of thicknesses of between 6 and 20 inches.

29. The sleeper cooling system of claim 16, wherein an optional adjustable mount may be utilized with mattresses of thicknesses of between 3 and 30 inches.

* * * * *